United States Patent [19]

Ono

[11] 3,962,983

[45] June 15, 1976

[54] CONNECTING STRUCTURE FOR OCEAN-GOING PUSH-BARGE

[75] Inventor: Hiromu Ono, Nishinomiya, Japan

[73] Assignee: Aoki Construction Company Limited, Osaka, Japan

[22] Filed: Mar. 25, 1975

[21] Appl. No.: 561,880

[30] Foreign Application Priority Data

Dec. 11, 1974 Japan ..... 49-149304

[52] U.S. Cl. ..... 114/235 R

[51] Int. Cl.[2] ..... B63B 21/00

[58] Field of Search ..... 114/235 R, 235 A, 77 R, 114/77 A; 24/263 DH

[56] References Cited

UNITED STATES PATENTS

| | | | |
|---|---|---|---|
| 3,345,970 | 10/1967 | De Long | 114/235 R |
| 3,568,621 | 3/1971 | Kawasaki | 114/235 R |
| 3,844,245 | 10/1974 | Yamaguchi | 114/235 R |

*Primary Examiner*—Trygve M. Blix
*Assistant Examiner*—Jesus D. Sotelo
*Attorney, Agent, or Firm*—Lewis H. Eslinger

[57] ABSTRACT

In connecting a bow of a pusher boat having a driving power source with a stern of a barge having no driving power source at a recessed portion formed at the stern of the barge, a plurality of freely projectable connecting pins provided at positions in the vicinity of center part of both sides as well as at the bow of the pusher boat are inserted into connecting pin receiving ports formed at corresponding positions in the recess of the barge so as to make both pusher boat and barge to be unified into a single navigable body, and the connecting pins at both sides of the pusher boat and the connecting pin receiving ports provided at the recessed portion at the stern of the barge are arranged in a backward obliquity, or swept back direction, with respect to the lengthwise direction of the boat hull.

4 Claims, 6 Drawing Figures

CONNECTING STRUCTURE FOR OCEAN-GOING PUSH-BARGE

BACKGROUND OF THE INVENTION

This invention relates to a connecting device for the so-called ocean-going pusher boat, in which a recessed portion is formed at the stern of a barge having no driving power source, into which the bow of a pusher boat having a driving power source is connected to join both pusher boat and barge into a single navigable body.

In this type of the ocean-going pusher boat, in which the pin-connection system is adopted, when the connecting pins are arranged horizontally and yet vertically with respect to the travelling direction of the barge, loads to be applied to these connecting pins due to sea waves, etc. during the navigation are, besides the moving force in the front and rear directions, moving force in the up-and-down direction, moving force in the lateral direction, and composite force in these various directions, hence the connection is vulnerable in its mechanical strength, and disadvantageously inferior in its anti-wave performance.

SUMMARY OF THE INVENTION

In view of such defects inherent in the heretofore known construction, it is an object of the present invention to provide an ocean-going pusher barge which is capable of eliminating the defects brought about by the conventional connecting mechanism as described in the foregoing.

It is another object of the present invention to provide an ocean-going pusher boat having large anti-wave performance, and which is constructed in such a way that a concaved recess which is sufficiently large to permit the bow of the pusher barge to be intromitted thereinto is provided at the stern of a barge, connecting pins are provided at three positions on the pusher boat, i.e., at a position in the vicinity of the bow of the pusher boat, and one at each position in the vicinity of the center part of both sides thereof, receiving ports for the connecting pins are provided at the three corresponding positions on the barge, then the pusher boat and the barge are fixedly connected each other at these three points by intromission of the connecting pins into the corresponding receiving ports, and the connecting pins at both sides of the pusher boat and the receiving ports for the connecting pins provided at the concaved portion of the barge at the respective positions corresponding to the connecting pins are so arranged that they are swept back with respect to the lengthwise direction of the respective hulls, whereby shearing force caused to the connecting pins due to the force in the back-and-forth direction is reduced from among those loads to be imparted to the hulls owing to sea waves, and other external forces during navigation of the barge.

The foregoing objects and other objects as well as detailed constructions and functions of the connecting device according to the present invention will become more apparently understandable from the following description thereof, when read in conjunction with the accompanying drawing.

DETAILED DESCRIPTION OF THE PREFERRED EMBODIMENTS

Figure 1:
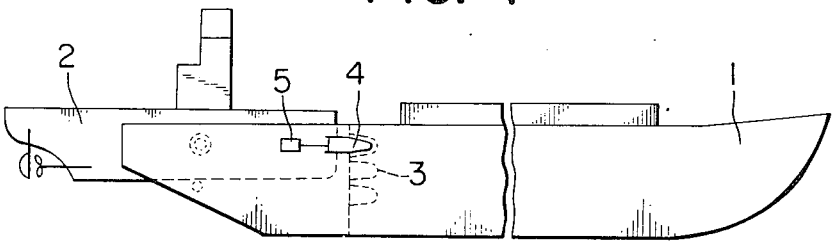
FIG. 1 is a side elevational view showing an embodiment of the connection between the pusher boat and the barge.
Figure 2:
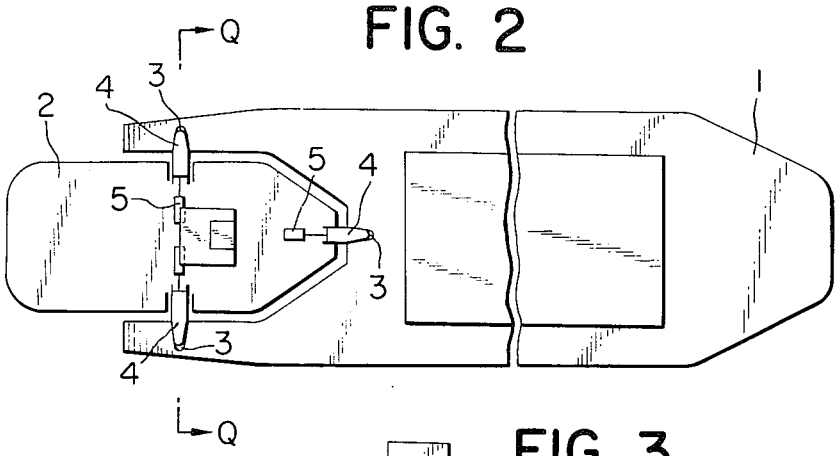
FIG. 2 is a plan view showing one embodiment of connection between the pusher boat and barge as shown in FIG. 1.

First of all, explanations will be made hereinbelow with reference to the connecting system shown in FIGS. 1, 2, and 3. This connecting device is constructed in such a way that a plurality of connecting pins 4 are provided at the bow and both sides of the pusher boat 2, and a plurality of connecting pin receiving ports 3 are provided at the stern and both sides of the barge 1 to be pushed by the pusher boat 2 at positions corresponding to the respective connecting pins 4. The connecting pins 4 are linked to each piston rod 6 of cylinders 5 installed in the pusher boat 2 in a manner to be freely projectable from the pusher boat 2. By the intromission of these connecting pins 4 into the corresponding connecting pin receiving ports 3, the barge and the pusher boat can be fixedly connected at three points.

Figure 3:
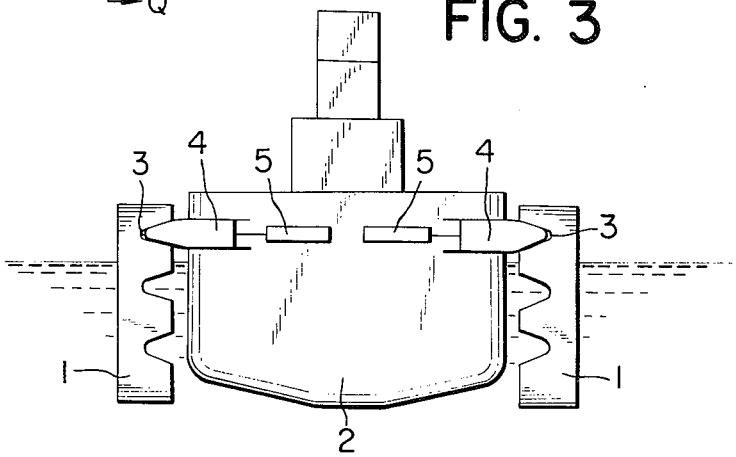
FIG. 3 is a cross-sectional view taken along the line Q — Q in FIG. 2.

As shown in FIG. 3, the connecting pin receiving ports 3 are formed in a plurality of stages in the vertical direction of the barge. Such layout of the connecting pin receiving ports 3 broadens the range of coupling between the barge and the pusher boat in accordance with the draught of the barge, whereby the connecting pins 4 can be intromitted into any arbitrary receiving ports.

Further, the connecting pins 4 which are freely projectable by means of the cylinders 5 may adopt either construction wherein they are intromitted into and retracted from the pin receiving ports by an independent cylinder provided at each of the left and right sides, or wherein they are simultaneously intromitted or retracted at both left and right sides by means of a common cylinder. In the case of the latter, the connecting pins are operated by a single common cylinder, hence sufficiently large force of intromission and retraction can be obtained at the time of both intromission and retraction.

Besides the above, in order to smoothen the movement of the connecting pins 4 into and out of the connecting pin receiving ports, it is better to feed lubricant into the connecting pin receiving ports.

Figure 4:
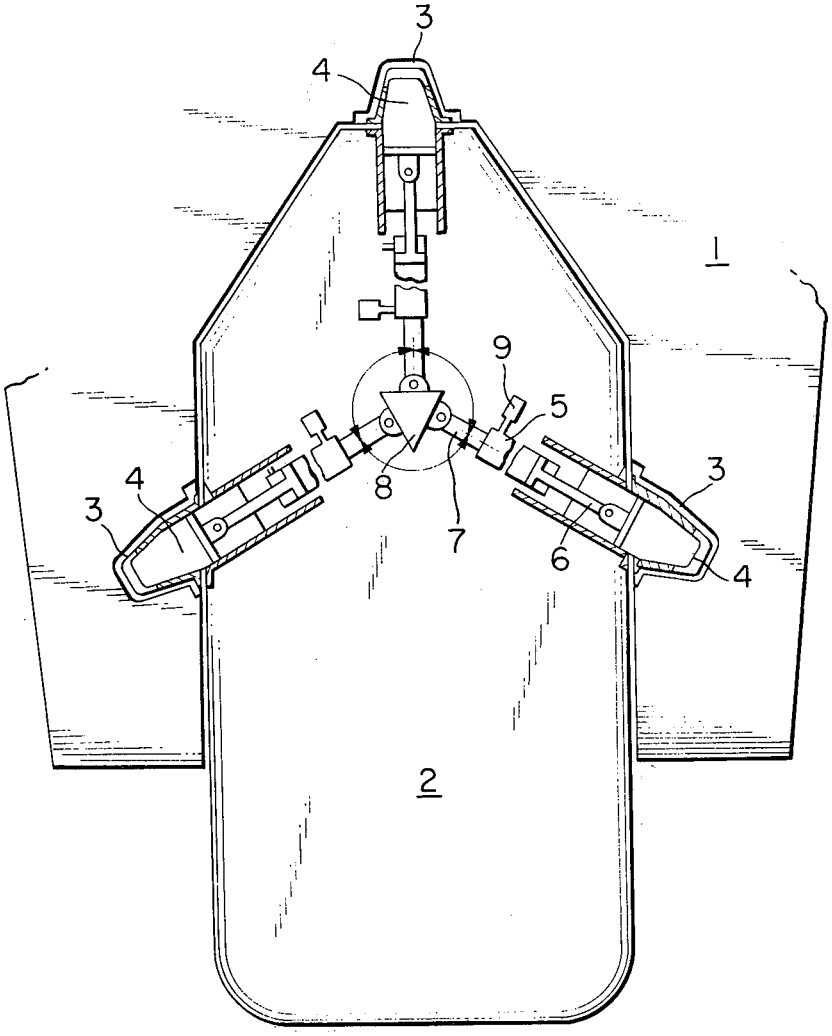
FIG. 4 is a plan view showing the principal of the connecting device according to the present invention.

In the connecting device for the ocean-going pusher boat of the above-described construction according to the present invention, the connecting pins 4 at both sides of the pusher boat 2 are not arranged horizontally as shown in FIG. 3, but arranged at a sweep back angle as shown in FIG. 4, for example, at a sweep back angle of 30°, in conformity to which the connecting pin receiving ports 3 are also arranged in the same swept back direction.

In more detail, the connecting pins 4 and the connecting pin receiving ports 3 are both formed in a tapered shape, and their surfaces are covered with an elastic material such as rubber, neoprene, and so forth, depending on necessity, so that, when the connecting pins are intromitted into the corresponding receiving ports, they are so tightly engaged that there remains no clearance between them. When the connecting pins and the corresponding connecting pin receiving ports are constructed in this manner, least resistance occurs at the time of insertion and retraction of the former into and from the latter in comparison with the case of the conventional cylindrical pins, hence the connection and disconnection between the pusher boat and the barge can be performed very easily.

Each cylinder 5 at the bow, and at both sides of the hull is fixed at a supporting column 8 in a triangular shape stemmed in the pusher boat by means of the connecting rods. In this case, the angle between the adjacent rods 7 naturally assumes 120°. Thus, with each connecting rod 7 being disposed at an equally divided angle onto the supporting column 8, the external force imparted to the connecting pin is mutually offset to maintain balance of the hull.

It is of course possible that, instead of fixing the connecting rods to a single supporting column 8, they can be fixed individually to an appropriate portion in the hull.

Further, as shown in the drawing, a pressure accumulator 9 is provided at the cylinder 5, which functions to constantly impart fluid pressure to the piston so that the connecting pins 4 may not be drawn out of the connecting pin receiving ports by the force of sea waves and other external forces. By this construction, the piston rods 6 constantly work to press-contact the connecting pins 4 towards the connecting pin receiving ports 3.

Figure 6:
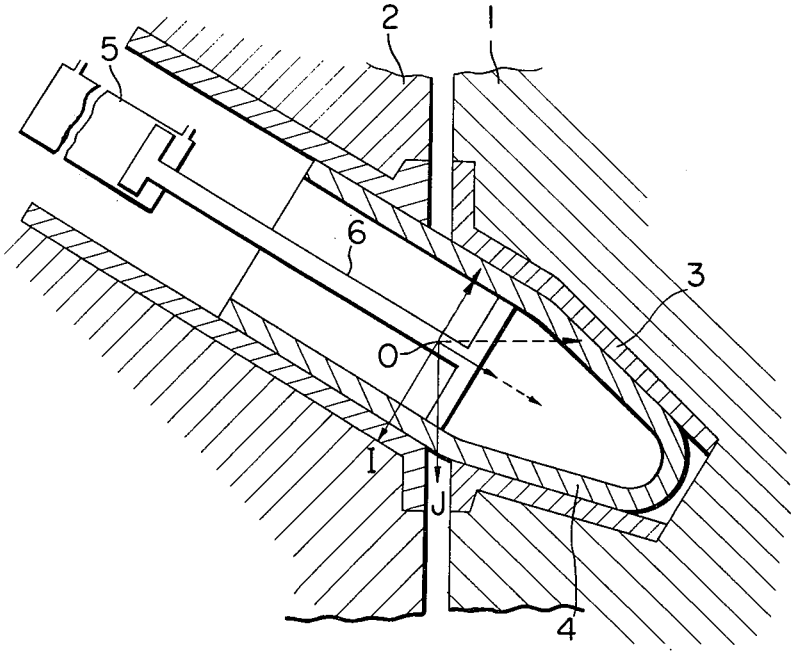
FIG. 6 is a diagram showing the way, in which force is applied to the connecting pins at both sides of the hull in the device according to the present invention.

In the ocean-going pusher boat of the above-described, when external force is imparted to the pusher boat from the forward direction, the pusher boat 2 is subjected to a force OJ which tends to cause the pusher boat to separate backward from the barge as shown in FIG. 6. At this time, a component of force OI ($\cos 30° \approx 0.86$) acts on the connecting pins 4 at both sides of the pusher boat as shearing force. However, as the connecting pins and the corresponding receiving ports are arranged at a sweep back angle with respect to the forwarding direction of the barge, the shearing force to be imparted thereto reduces in comparison with the case where the connecting pins 4 are arranged perpendicularly with respect to the lengthwise direction of the hull. In the meantime, the connecting pin 4 at the bow of the pusher boat 2 tends to leave the connecting pin receiving port 3, hence no shearing force whatsoever acts thereon.

Figure 5:
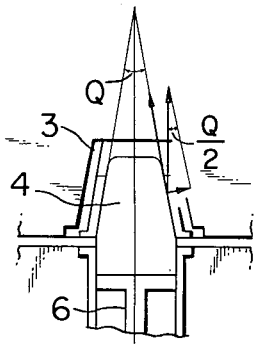
FIG. 5 is a diagram showing the way, in which force is applied to the connecting device at the center part of the bow in the device according to the present invention.

On the other hand, when such external force is imparted to the pusher boat from the backward direction, a force just opposite to that from the above-mentioned forward direction is imparted to the barge. However, as shown in FIG. 5, this opposite force can be received by the tapered part of the connecting pin 4 at the center part of the bow, so that, if the tapering angle is assumed to be $\theta/2 = 7.5$ degrees, only a slight shearing force of $\sin 7.5° = 0.12$ acts on the connecting pin. In this case, all the external force is received by the connecting pin 4 and the corresponding receiving ports 3 at the center part of the bow, so that the connecting pin at both sides of the hull are not affected at all.

As stated in the foregoing, according to the present invention, the shearing force to be applied onto the connecting pins becomes smaller than that in the case of their being arranged horizontally, hence the connecting pins can be shortened in length, and, at the same time, anti-wave performance remarkably and characteristically improves along with the fixing-and-connecting mechanism at three points according to the present invention.

Although the present invention has been described with particular reference to a preferred embodiment thereof, it is to be noted that such embodiment is merely illustrative and not restrictive, and that any change and modification may be made within the spirit and scope of the present invention as recited in the appended claim.

What is claimed is:

1. A connecting structure for an ocean-going push-barge combination which comprises, a pusher boat having a bow, sides and a stern, said pusher boat including at least three connecting pins respectively located at the bow and both sides thereof; said connecting pin at the bow extending generally axially of the boat in a forward direction and said connecting pins on the sides of the boat extending outwardly therefrom in opposite directions and at sweep back angles inclined towards the boat's stern; said pins being slidably mounted in the boat for movement outwardly and inwardly thereof; said connecting pins being located at 120° with respect to each other; an unpowered barge having a longitudinally extending stern including a generally concave notch formed therein which extends entirely through the stern of the barge and has a configuration generally complementary to the bow of the boat to permit entrance thereinto of the bow and both sides of said pusher boat, where said connecting pins are located, said stern of the barge having generally vertically extending side walls defining the notch and said sidewalls having a plurality of ports therein for receiving and holding said connecting pins, when said pins are protruded from said pusher boat, the receiving and holding ports for the pins on the sides of the boats being located in sweep back angles towards the stern of the barge corresponding to the angle of said connecting pins, and means in said boat for extending and retracting said pins into and out of the ports in the barge that are generally aligned therewith, whereby said pusher boat and barge are adapted to be rigidly separably joined to the barge at a plurality of points on the bow and the two sides thereof to form a single ocean going unit when said pins are extended with reduced shearing force imparted to the pins during navigation.

2. The structure as defined in claim 1 wherein said means for extending and retracting the pins comprises a common central support in said boat and three fluid actuated double acting cylinders respectively connected between said common support and an associated pin.

3. A connecting structure for an ocean-going push-barge combination which comprises:

a. a pusher boat having a bow, sides, and a stern; said pusher boat including at least three connecting pins respectively located at the bow and both sides thereof, said connecting pin at the bow extending generally axially of the boat in a forward direction, said connecting pins on the sides of the boat extending outwardly therefrom in opposite directions and at sweep back angles inclined towards the boat's stern, and said pins being slidably mounted in the boat for movement outwardly and inwardly thereof;

b. an unpowered barge having a longitudinally extending stern including a generally concave notch formed therein which extends entirely through the stern of the barge and has a configuration generally complementary to the bow of the boat to permit entrance thereinto of the bow and both sides of said pusher boat, where said connecting pins are located, said stern of the barge having generally vertically extending side walls defining the notch and said side walls having a plurality of ports therein for receiving and holding said connecting pins, when said pins are protruded from said pusher boat, the receiving and holding ports for the pins on the sides of the boat being located at sweep back angles towards the stern of the barge corresponding to the angle of said connecting pins; and c. means in said boat for extending and retracting said pins into and out of the ports in the barge that are generally aligned therewith, and which comprises a common central support in said boat and three fluid actuated double acting cylinders respectively connected between said common support and an associated pin.

4. The structure as defined in claim 3, wherein said connecting pins are located at 120° with respect to each other.

* * * * *